United States Patent [19]

March et al.

[11] Patent Number: 4,527,677

[45] Date of Patent: Jul. 9, 1985

[54] CARRYING CASE WITH REMOVABLE DIVIDER ASSEMBLY

[75] Inventors: Joseph E. March; Thomas E. Riley, both of Chicago, Ill.

[73] Assignee: Platt Luggage, Inc., Chicago, Ill.

[21] Appl. No.: 518,007

[22] Filed: Jul. 28, 1983

[51] Int. Cl.[3] ..... A45C 13/02; A45C 13/04; A45C 13/36; B65D 81/00

[52] U.S. Cl. ..... 190/110; 190/114; 190/122; 190/127; 206/334

[58] Field of Search ..... 190/109, 110, 111, 127, 190/122, 114; 206/334

[56] References Cited

U.S. PATENT DOCUMENTS

| | | | |
|---|---|---|---|
| 627,374 | 6/1899 | Wood | 190/122 X |
| 767,898 | 8/1904 | Lamphier | 190/110 X |
| 1,028,168 | 6/1912 | Williams | 190/127 |
| 1,636,060 | 7/1927 | Kennedy | 190/114 |
| 1,658,997 | 2/1928 | Mulford et al. | 190/109 |
| 2,389,601 | 11/1945 | De Witt | 229/23 |
| 3,023,867 | 3/1962 | Kotkins | 190/113 |
| 3,084,771 | 4/1963 | Davis | 190/113 |
| 3,169,615 | 2/1965 | Stein | 190/114 |
| 3,259,217 | 7/1966 | Platt | 190/115 |
| 3,330,888 | 7/1967 | Stein | 190/110 |
| 3,881,580 | 5/1975 | Doppelt | 190/114 |
| 3,938,630 | 2/1976 | March | 190/24 |
| 4,330,050 | 5/1982 | Sangster et al. | 190/110 |
| 4,374,555 | 2/1983 | March | 190/114 |

FOREIGN PATENT DOCUMENTS

| | | | |
|---|---|---|---|
| 2922 | 4/1878 | Fed. Rep. of Germany | 190/124 |
| 1235491 | 5/1960 | France | 190/109 |
| 1253921 | 1/1961 | France | 190/109 |
| 142251 | 5/1920 | United Kingdom | 190/54 |
| 1586482 | 3/1981 | United Kingdom | 206/334 |

*Primary Examiner*—William Price
*Assistant Examiner*—Sue A. Weaver
*Attorney, Agent, or Firm*—Fitch, Even, Tabin & Flannery

[57] ABSTRACT

A carrying case includes a wall member which provides a bottom and sidewalls for the carrying case and which has at each of its opposite ends an end assembly including a generally planar plastic end panel having a pair of metal end frames extending about its periphery. The end panels may be cut from flat sheets of material and need not be molded into specialized shapes. In the preferred embodiment, the end panels are made substantially of antistatic materials which enable the case to be useful in transporting items which might be damaged by static electricity. The case illustrated herein includes a divider assembly which is removable as a unit from the case and which is made substantially of antistatic materials.

7 Claims, 8 Drawing Figures

FIG. 1
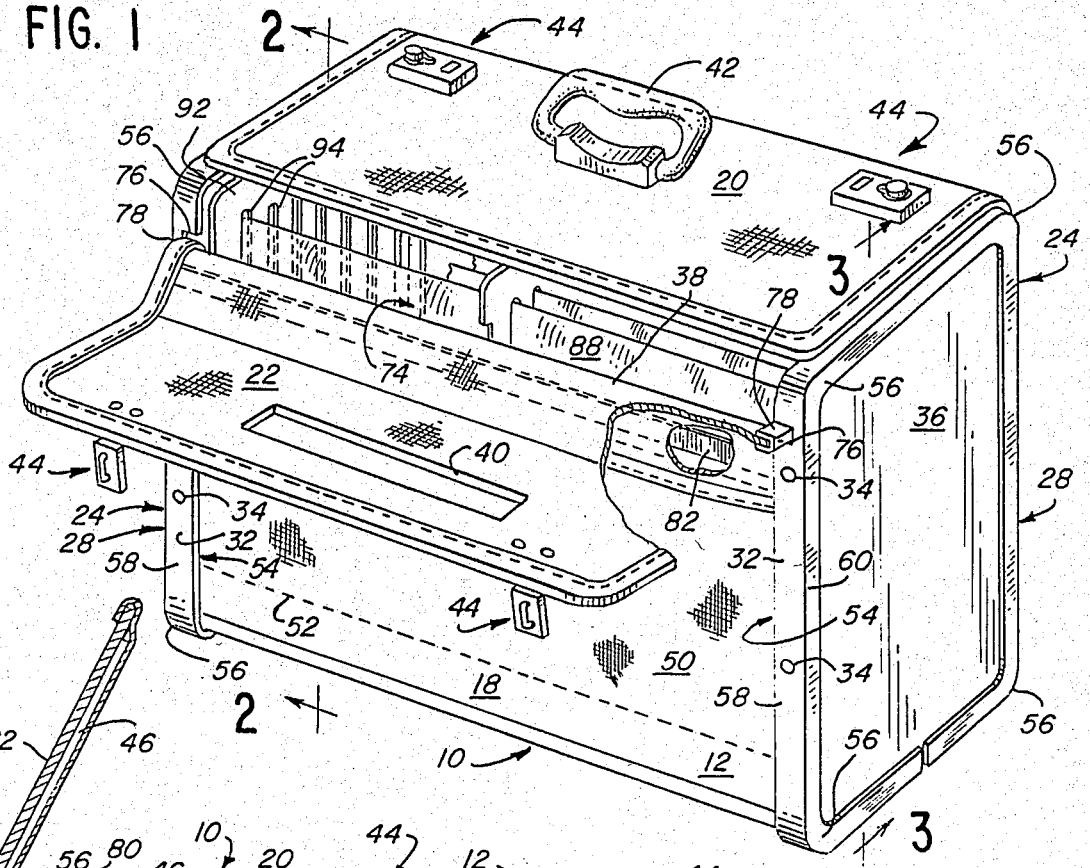
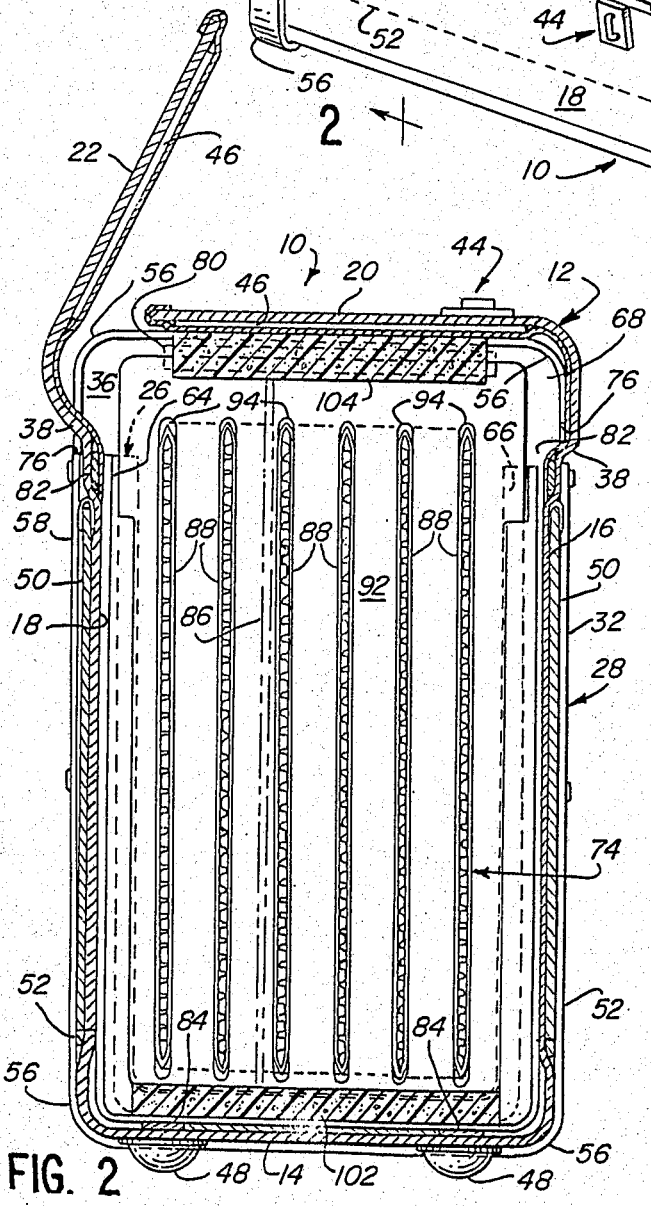
FIG. 2
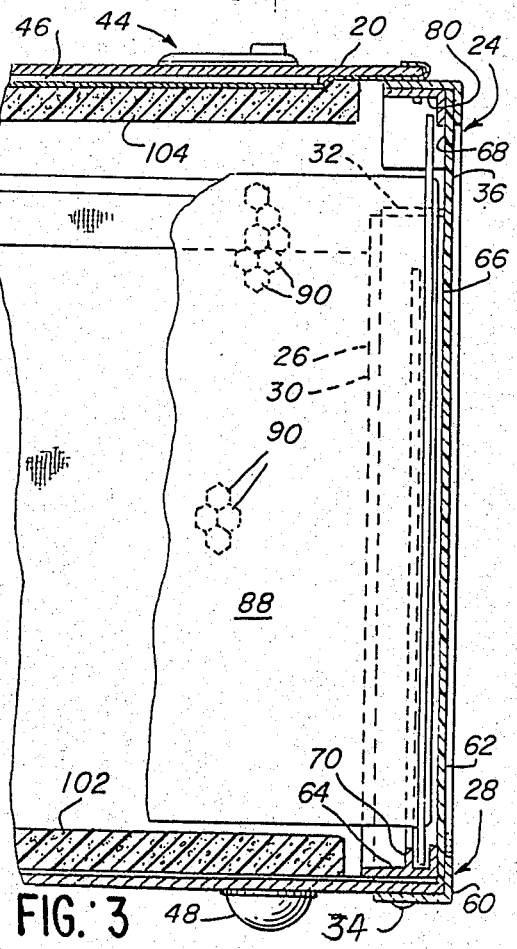
FIG. 3

FIG. 5
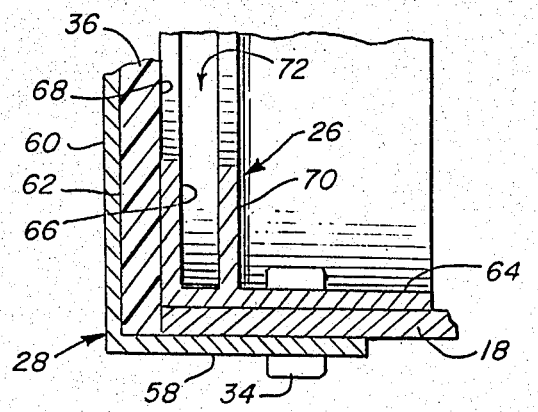
FIG. 6
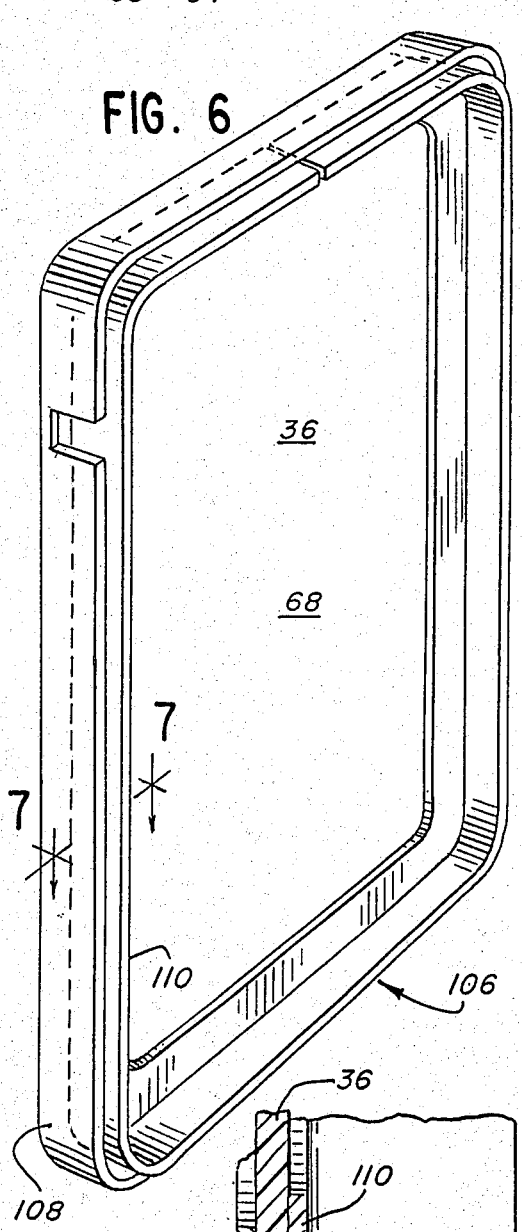
FIG. 4
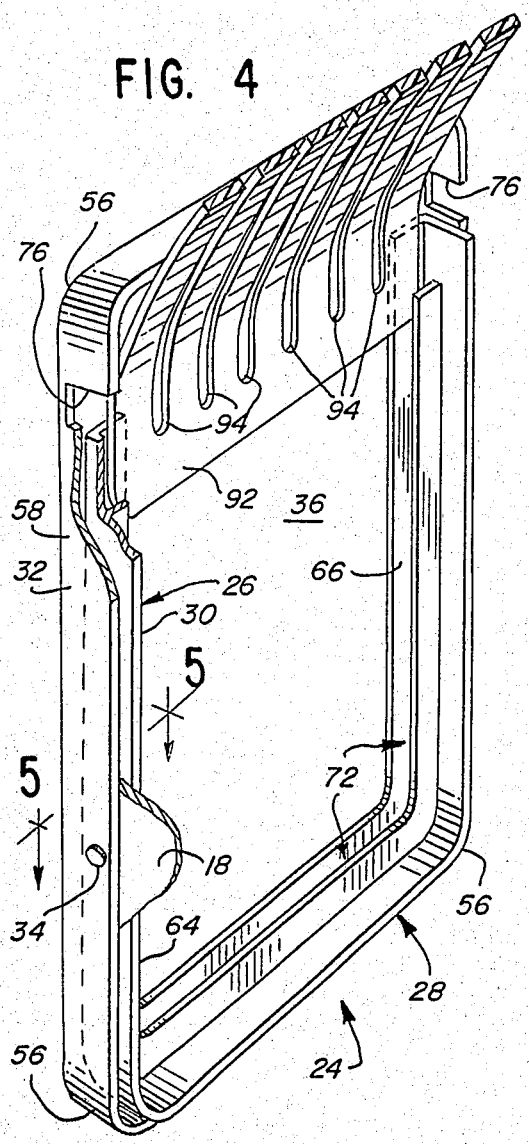
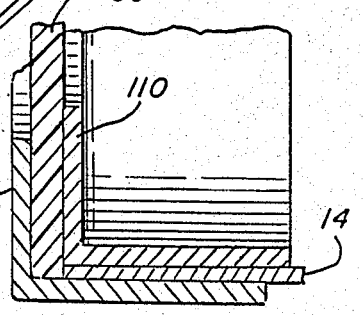
FIG. 7

CARRYING CASE WITH REMOVABLE DIVIDER ASSEMBLY

BACKGROUND OF THE INVENTION

The present invention relates generally to carrying cases and more particularly to a carrying case which may be made of conventional materials so as to be suitable for use in carrying various articles or which may be made substantially of antistatic materials so as to be particularly suitable for use in carrying articles which are sensitive to discharges of static electricity.

It is generally desirable that carrying cases be relatively light in weight to facilitate handling, as well as strong and durable. U.S. Pat. No. 3,259,217 to Platt discloses a carrying case which has proven successful in providing these features. This case includes a pair of spaced rigid end shells having peripheral flanges forming inwardly facing opposed grooves or channels. A unitary member including a bottom wall and a pair of side walls interconnects the end shells with its opposite ends extending into the inwardly facing channels of the end shells. A pair of overlapping lid pieces extend longitudinally of the side walls and are pivotally secured thereto.

U.S. Pat. No. 4,374,555 and co-pending application Ser. No. 468,575 entitled "Carrying Case" disclose carrying cases which also employ opposed molded end shells interconnected by a unitary member. While the use of such molded end shells provides many advantages over various other possible constructions, it may be desirable to construct a case having end members which are not readily moldable into shapes which provide the desired features or which are relatively expensive to mold into such shapes.

For example, antistatic materials which have been found to be useful in packaging certain types of items present greater difficulty in molding than materials which have generally been used in the past to form the end shells of the above-referenced cases. Antistatic materials have electrical properties which inhibit or prevent rapid discharge of static electricity, and are used in packaging of items such as sensitive electronic components which are subject to damage by static electricity. One such material is a transparent polyethylene sold by Richmond Division of Dixico Incorporated under the registered trademark RCAS 1200.

One of the problems addressed by the present invention reates to providing a carrying case which includes some of the proven structural features of the above-referenced cases and which may be made without molded end shells so that any of various different materials may be used in constructing the ends of the case.

SUMMARY OF THE INVENTION

In accordance with the present invention, a carrying case is provided which includes a wall member which provides a bottom and sidewalls for the carrying case and which has at each of its opposite ends an end assembly including a generally planar plastic end panel having a pair of metal end frames extending about its periphery. The end panels may be cut from flat sheets of material and need not be molded into specialized shapes. In the preferred embodiment, the end panels are made substantially of antistatic materials which enable the case to be useful in transporting items which might be damaged by static electricity.

The case illustrated herein includes a divider assembly which is removable as a unit from the case and which is made substantially of antistatic materials.

Accordingly, it is an object of the present invention to provide a carrying case which provides strength and durability but which is not made with molded plastic end shells.

It is a further object of the present invention to provide a carrying case which is suitable for carrying items which are subject to damage by discharge of static electricity.

Additional objects and features of the present invention are set forth below.

BRIEF DESCRIPTION OF THE DRAWINGS

FIG. 1 is a perspective view of a carrying case in accordance with the present invention, shown with portions broken away for clarity.

FIG. 2 is a transverse sectional view of the carrying case of FIG. 1 taken substantially along line 2—2 of FIG. 1.

FIG. 3 is a fragmentary longitudinal sectional view of the carrying case of FIG. 1 taken substantially along line 3—3 in FIG. 1 and having portions broken away for clarity.

FIG. 4 is an enlarged perspective view of the end frames of the carrying case of FIG. 1, shown in assembled relation.

FIG. 5 is an enlarged fragmentary sectional view of portions of the end frames of FIG. 4, taken substantially along line 5—5 of FIG. 4.

FIG. 6 is an enlarged perspective view of a pair of end frames in accordance with a second embodiment of the present invention, shown in assembled relation.

FIG. 7 is an enlarged fragmentary view of portions of the end frames of FIG. 6, taken substantially along line 7—7 of FIG. 6.

DESCRIPTION OF THE PREFERRED EMBODIMENT

Figure 8:
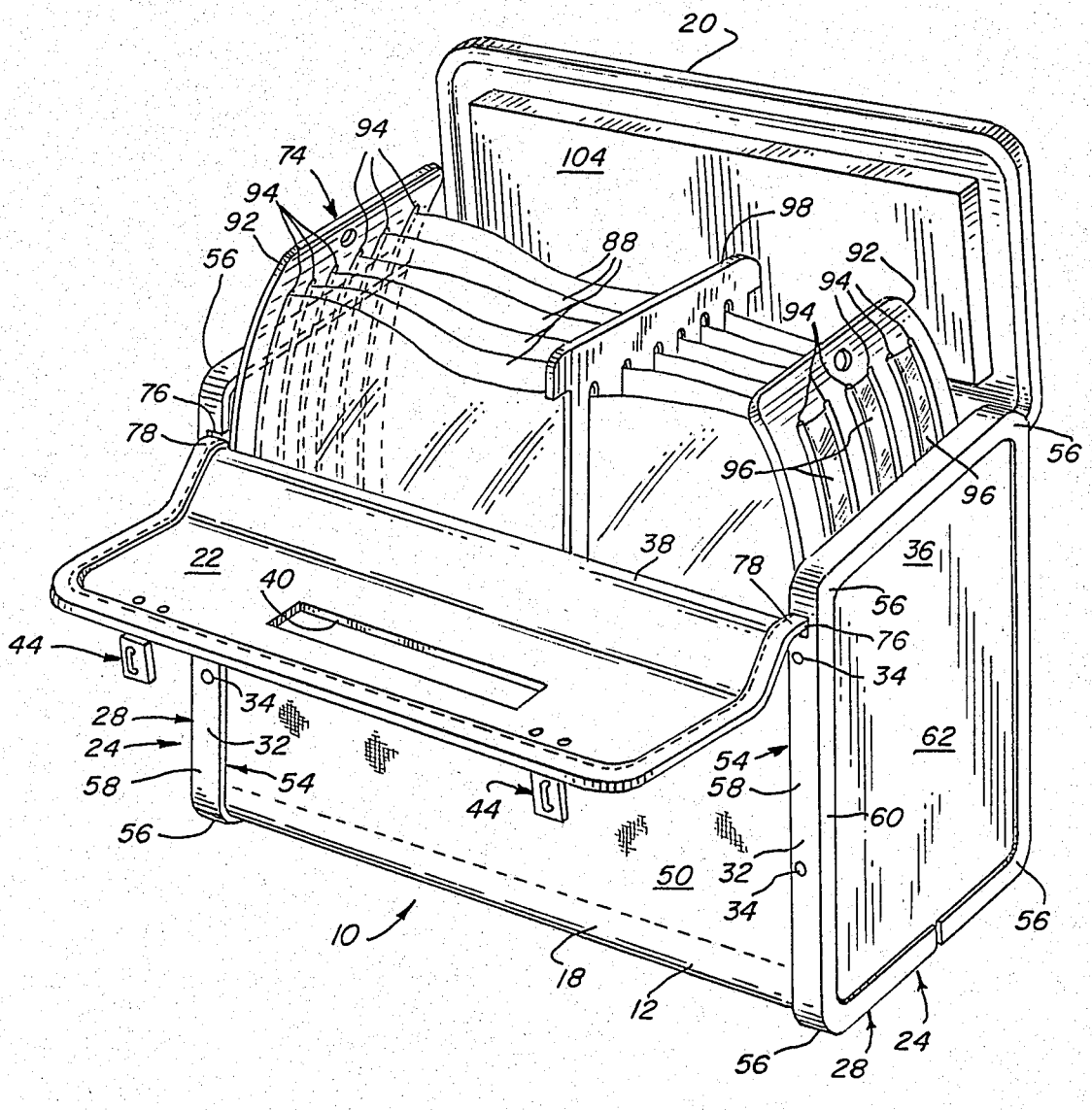
FIG. 8 is a perspective view of the case of FIG. 1, shown with the divider assembly partially removed.

The present invention is generally embodied in a carrying case, indicated generally at 10, which includes a wall member 12 comprising a bottom wall 14, a pair of sidewalls 16 and 18 extending upwardly from opposite sides of the bottom wall, and first and second lid flaps 20 and 22 positioned above the sidewalls; and a pair of end assemblies 24 which are fastened to opposite ends of the wall member 12. The lid flaps 20 and 22 are pivotal about flexible portions of the wall member so as to be movable between a closed position wherein the first lid flap 20 is partially covered by the second lid flap 22 and an open position for providing access to the interior of the case 10.

In the past, molded plastic end shells have been fastened to opposite ends of carrying cases, as described in U.S. Pat. Nos. 3,259,217 and 4,374,555, and co-pending application Ser. No. 468,575. In such carrying cases, the ends of the sidewalls and bottom wall are held within peripheral channels on the shells.

In accordance with the present invention, a carrying case 10 is provided which has at each of its opposite ends an end assembly 24 which includes inner and outer metal end frames 26 and 28 respectively providing parallel spaced U-shaped portions 30 and 32 between which end portions of the sidewalls and bottom wall are clamped to secure the respective end assembly 24 to the wall member 12. Fasteners 34 such as rivets are used to secure the end portions to the end frames. Use of the metal end frames 26 and 28 as described above eliminates the need for a molded plastic end shell, and enables a pair of generally planar panels 36 held in place by the end frames 26 and 28 to be used as ends for the carrying case. The metal end frames 26 and 28 add strength to the case by providing metal surfaces for both ends of the rivets 34 to engage. An additional advantage of the end assemblies 24 of the present invention is that they may facilitate assembly of the case, as explained in greater detail below.

In the preferred embodiment, the end panels 36 are made of relatively rigid antistatic material, and various other antistatic features are provided as described below to enable the case to be used for carrying items sensitive to static electricity, such as printed circuit boards with sensitive electronic components installed on them. It will be understood, however, that the scope of the present invention is not limited to antistatic carrying cases.

Turning now to a more detailed description of the preferred embodiment of the present invention, the wall member which comprises the bottom 14, sidewalls 16 and 18, and first and second pivotal lid flaps 20 and 22 is preferably of unitary construction. The lid flaps 20 and 22 pivot about flexible portions 38 of the wall member which extend along the tops of the respective sidewalls 16 and 18. The second lid flap 22 has a rectangular opening 40 formed through it to accommodate a handle 42 which is affixed to the first lid flap 20. When the lid flaps 20 and 22 are in closed position, the second lid flap 22 overlays the first lid flap 20 to partially cover it, and the handle 42 extends upwardly through the opening 40. Locking means 44 are provided for maintaining the lid flaps in closed position. The locking means herein include a pair of latch assemblies, one positioned near each end of the case. Cardboard inserts 46 maintain the stiffness of the overlapping portions of the lid flaps 20 and 22 to inhibit deformation of the lid flaps when the case 10 is supported by the handle 42. Feet 48 are provided for supporting the carrying case 10 from below.

The illustrated case has an exterior side pocket 50 extending the length of each sidewall 16, 18. The bottom 52 of each side pocket 50 is stitched to its associated sidewall along the length of the case. The ends 54 of the pockets 50 are clamped between the end frames 26 and 28 along with the adjacent ends of their associated sidewalls 16 and 18.

As described above, each end assembly 24 includes a generally planar plastic end panel 36 held in place by inner and outer end frames 26 and 28. The outer end frame 28 is generally rectangular with rounded corners 56 and is of generally L-shaped cross section.

The outer end frame 28 includes a generally rectangular longitudinal portion 58 which peripherally surrounds its associated end panel 36 and a generally rectangular transverse flange 60 which abuts a peripheral portion of the exterior surface 62 of the end panel 36. Referring particularly to the embodiment illustrated in FIGS. 4 and 5, the inner end frame 26 may be generally U-shaped and co-extensive with the bottom and side portions of the outer end frame. In this embodiment, the inner end frame 26 has a generally F-shaped cross section, and includes a generally U-shaped longitudinal portion 64, a first generally U-shaped transverse flange 66 abutting peripheral portions of the interior surface 68 of the end panel, and a second transverse generally U-shaped flange 70 spaced from the first flange 66 to define inwardly facing channels 72 along the sides and bottom of the inner end frame 26. The channels 72 function as mounts for a divider assembly 74 as explained in further detail below.

In each end assembly 24, the end panel 36 is held between the first transverse flange 66 of the inner end frame 26 and the transverse flange 60 of the outer end frame 28. The ends of the sidewalls 16, 18 and bottom 14 of the case 10 are clamped between the generally U-shaped longitudinal portion 64 of the inner end frame 26 and the adjacent portion of the generally rectangular longitudinal portion 58 of the outer end frame 28, and secured in place by rivets 34. The clamping engagement is illustrated fragmentarily in FIG. 4. As best seen in FIG. 1, slots 76 are formed in the outer end frames 28 even with the flexible portions 38 of the wall member 12 so that the sidewalls 16 and 18 may be clamped between the respective end frames 26 and 28 at each end and the lid flaps 20 and 22 may have their ends outside of the outer end frames 28 so as to be free to pivot without interrupting the continuity of the edge 78 of the wall member 12. A short length of angle 80 may be affixed to an upper portion of the outer end frame 28 to reinforce it.

The illustrated embodiment includes reinforcing bars 82 and 84 extending between the opposite end assemblies 24 and 26 to strengthen the case. In the illustrated embodiment, one pair of bars 82 extends along each sidewall 16, 18 just below the flexible portion 38 of the wall member 12 and another pair of bars 84 is disposed along the bottom 14 of the case 10. Locating the bars 84 in the bottom 14 of the case has been found to make assembly simpler than in prior cases where such bars were disposed near the bottom of each side wall, due to clearances on riveting apparatus. The bars 82 and 84 are secured at their ends to the end assemblies 24 by the rivets 34. The bars 82, 84 are preferably made of spring steel which provides relatively high strength and which enables the bars to return to straight configurations after being bent so that the case 10 returns to its original shape after being overloaded.

As mentioned above, the present invention is preferably embodied in a carrying case 10 having various antistatic features to enable it to be used for carrying items which are sensitive to discharges of static electricity, such as printed circuit boards having sensitive electronic components installed on them. It is generally desirable that materials contacting such items be nonconductive so that static electricity generated outside of the case may not be transmitted to or through the items within the case. It is further desirable that the material not exhibit a tendency to generate static charges when sliding against or being pulled away from other material. In addition, it is desirable that the materials be capable of dissipating static charges which may be transmitted to their surfaces.

To this end, the end panels 36 in the preferred embodiment are made of polyethylene material containing an internal organic antistat. Antistatic polyethylene is commonly color coded pink and is commonly referred to in the industry as "pink poly". One such antistatic polyethylene is sold by Richmond Division of Dixico Corporation under the registered trademark RCAS 1200.

The antistatic end panels 36 do not generate static charges under normal conditions, and will not conduct damaging currents of static electricity. The organic antistat renders all surfaces of the end panel static conductive to enable static charges to bleed off at a safe rate. Thus, should the end panels become charged by static electricity, the static conductive surfaces will dissipate the charge without permitting damaging static current to reach the items inside the case.

The wall member 12 of the case is preferably made substantially of cotton duck. This material will not generate static charges under normal conditions, and is an insulating material so that it will not transmit damaging static charges to the interior of the case.

In addition to the components described above, the carrying case of the present invention may include an antistatic divider assembly 74. The divider assembly enables a plurality of items 86 to be carried within the case while isolated from one another both physically and electrically. The divider assembly preferably includes a plurality of antistatic longitudinal walls 88 extending generally parallel to the sidewalls 16, 18 of the case. One material which has been found suitable for construction of the longitudinal walls 88 is a plastic material which contains antistatic resins and which is configured to enclose air pockets 90 to provide cushioning for articles packaged in it. This material is sold under the trademark CANCEL-3 by ADE, Inc. The antistatic resins form a microscopic, conductive, noncorrosive layer over the surface of the material which bleeds off stray static charges imparted to the material. This makes the material particularly suitable for use with sensitive electronic components.

When the carrying case 10 is used to transport items such as printed circuit boards, leads having relatively sharp ends may protrude from the board and damage the longitudinal walls 88 of the divider. It is desirable that the divider assembly 74 be conveniently replaceable should it become damaged in this manner. To this end, the divider assembly 74 of the present invention is removable from the carrying case 10 as a unit.

The illustrated divider assembly 74 has an end wall 92 at each end. Each end wall 92 has a series of parellel slots 94 to accommodate the ends 96 of the longitudinal walls 88. The end of each longitudinal wall is heat sealed to that of an adjacent longitudinal wall to secure the walls 88 within their slots 94. In the embodiment illustrated in FIGS. 1–5 and FIG. 8, the channels 72 formed in the inner end frames slidably engage the peripheral bottom and side edges of the end walls 92 of the divider assembly 74 to enable the divider assembly to be conveniently installed and withdrawn from the case. The divider end walls 92 are preferably made of an antistatic material such as RCAS 1200 polyethylene.

It may be desirable to further subdivide the interior of the carrying case 10 so that a larger number of items may be carried within it while physically and electrically isolated from one another. To this end, one or more antistatic transverse divider members 98 may be provided. The illustrated transverse divider member has a series of open-ended parallel vertical slots 100 formed in it. The slots open downwardly to receive the longitudinal walls 88. The transverse divider member 98 is thus movable, and may be placed at any desired location along the length of the divider assembly 74, or may be removed from the case entirely. The transverse divider member 98 is preferably made of RCAS 1200 polyethylene.

To provide additional protection from static discharges and mechanical impacts, antistatic cushioning liners 102 and 104 may be secured to upper and lower interior surfaces of the case. As best viewed in FIGS. 2 and 3, the liners 102 and 104 may be made of antistatic elastomeric foam and may be secured to the interior surface of the bottom wall 14 and the interior surface of the first lid flap 20.

It will be appreciated that the carrying case 10 may be made from any desired material, and need not incorporate the antistatic features described above in reference to the preferred embodiment. As an alternative to the end assemblies 24 described above and illustrated in FIGS. 4 and 5, the end assemblies may be constructed as shown in FIGS. 6 and 7 at 106. Referring to FIG. 6, the outer end frame 108 is identical to that illustrated in FIG. 4 and described above, but the inner end frame 110 is of generally L-shaped cross section and is generally rectangular rather than generally U-shaped. The inner end frame 110 thus reinforces the outer end frame 108 about its entire periphery.

Employment of end assemblies according to either embodiment described above may facilitate assembly of the carrying case. In the past, where molded plastic end shells have been used, assembly of the case has required inserting end edges of the wall member into peripheral channels and then riveting the end edges of the wall members in place within the channels. Assembly of the case of the present invention does not require insertion of the end edges into preformed channels and thus may reduce the manual effort required to assemble the case. The corresponding steps in the assembly of the case of the present invention may be accomplished by positioning an end of the wall member 12 in the desired location within the outer end frame 28 or 108 after the end panel 36 has been put in place, placing the inner end frame 26 or 110 in position within the wall member, and then riveting the assembly together.

From the foregoing, it will be appreciated that the present invention provides a carrying case having novel end assemblies which provide substantial advantages over prior known carrying cases. In the preferred embodiment, the case may be suitable for transportation of items which are sensitive to discharges of static electricity. The scope of the invention is not limited to the preferred embodiment described above, or any other particular embodiment of the invention, but is defined by the appended claims.

What is claimed is:

1. A carrying case comprising:

a wall member comprising a bottom wall, first and second sidewalls extending upwardly from opposite sides of said bottom wall, and first and second mutually cooperable lid flaps positioned above said first and second sidewalls respectively and pivotable between open and closed positions, said lid flaps being configured to overlap partially when in closed position so that said first lid flap is partially covered by said second lid flap, said lip flap having a generally rectangular opening formed through it;

a handle which extends through said opening in said second lid flap when said lid flaps are in closed position;

locking means affixed to said lid flaps for securing them in closed position; and a pair of end assemblies, one fixed to each of the opposite ends of said wall member, each of said end assemblies including:

a generally planar end panel having an interior surface and an exterior surface, an outer end frame of generally L-shaped cross section extending peripherally about said end panel and having a generally rectangular transverse portion abutting a peripheral portion of said exterior surface and a generally rectangular longitudinal portion extending longitudinally of the case, a generally U-shaped inner end frame of generally F-shaped cross section having a generally U-shaped longitudinal portion, a first transverse U-shaped flange abutting peripheral bottom and side portions of said interior surface of said end panel, and a second transverse U-shaped flange generally parallel to said first transverse flange and spaced therefrom so that said first and second flanges define therebetween inwardly facing channels along the sides and bottom of said inner end frame, a plurality of rivets securing end portions of said sidewalls and said bottom wall to said end frames so that said end portions of said side walls and said bottom wall are clamped between said longitudinal portions of said inner and outer end frames, and a removable divider assembly positioned within the case including first and second generally rectangular end walls and a plurality of longitudinal divider walls extending between said end walls, each of said end walls having peripheral bottom and side portions slidably mounted within said inwardly facing channels on one of said inner end frames.

2. A carrying case in accordance with claim 1 wherein said wall member and said divider assembly are made substantially of antistatic material, and further comprising:

a first antistatic foam liner secured to an interior surface of said first lid flap;

a second antistatic foam liner secured to an interior surface of said bottom wall; and a plurality of elongated metal bars which extend between said end assemblies and which are fastened at opposite ends to said end assemblies to reinforce the carrying case.

3. A carrying case in accordance with claim 2 wherein said divider assembly further includes a generally rectangular transverse divider member having a series of open-ended parallel slots formed in it to receive said longitudinal divider walls so that said transverse divider member may be removably placed at a desired location on said divider assembly.

4. A carrying case in accordance with claim 3 wherein said end panels of said end assemblies and said end walls of said divider are made of antistatic polythylene.

5. A carrying case in accordance with claim 2 wherein said wall member is made substantially of cotton duck.

6. A carrying case in accordance with claim 2 wherein said longitudinal divider walls are made substantially of flexible antistatic material having air pockets formed therein to provide cushioning for materials transported in the case.

7. A carrying case in accordance with claim 6 wherein each of said end walls of said divider assembly has a plurality of parallel slots formed through it.

* * * * *